United States Patent [19]

Badstuebner et al.

[11] Patent Number: 4,896,759

[45] Date of Patent: Jan. 30, 1990

[54] HANDRAIL MOUNT DEFLECTOR FOR STREAMLINED ESCALATOR NEWELS

[75] Inventors: Hella Badstuebner; Walter Tietze, both of Stadthagen, Fed. Rep. of Germany

[73] Assignee: Otis Elevator Company, Farmington, Conn.

[21] Appl. No.: 337,192

[22] Filed: Apr. 12, 1989

[51] Int. Cl.[4] ..... B66B 29/08

[52] U.S. Cl. ..... 198/324; 198/335; 198/338

[58] Field of Search ..... 198/324, 335, 337, 338

[56] References Cited

U.S. PATENT DOCUMENTS

| | | | |
|---|---|---|---|
| 3,981,118 | 9/1976 | Johnson et al. | 198/335 |
| 4,798,274 | 1/1989 | Saito | 198/338 |
| 4,836,353 | 6/1989 | Adrian et al. | 198/335 |

FOREIGN PATENT DOCUMENTS

| | | | |
|---|---|---|---|
| 275507 | 6/1964 | Australia | 198/335 |
| 1274286 | 8/1968 | Fed. Rep. of Germany | 198/338 |
| 3602945 | 8/1987 | Fed. Rep. of Germany | 198/337 |
| 53-91283 | 8/1978 | Japan . | |
| 56-12289 | 2/1981 | Japan . | |
| 2053126 | 2/1981 | United Kingdom | 198/335 |

*Primary Examiner*—Joseph E. Valenza
*Attorney, Agent, or Firm*—William W. Jones

[57] ABSTRACT

A deflector is mounted on an escalator balustrade immediately below the moving handrail at the newel, or turnaround ends of the escalator. The deflector smooths the line between the handrail and balustrade and protects against clothing, packages, or the like, contacting the handrail in the exit newel end of the escalator. The deflector may be internally illuminated to heighten its awareness and design impact.

8 Claims, 1 Drawing Sheet

HANDRAIL MOUNT DEFLECTOR FOR STREAMLINED ESCALATOR NEWELS

TECHNICAL FIELD

This invention relates to an escalator or other passenger conveyor which has a thin, streamlined balustrade and handrail assembly, and more particularly, to a deflector mounted on the newels of the balustrade immediately adjacent to the moving handrail.

BACKGROUND ART

Highly streamlined escalators and horizontal passenger conveyors are in demand due to their elegant appearance. These devices are generally formed with a thin balustrade, which may be glass, plastic, or metal, over which the moving handrail passes. The handrail and its guide, which is secured to the balustrade, are much wider than the balustrade which, as noted, is very thin. By way of example, the width of the handrail can be eight times or more than the thickness of the balustrade. This difference in width can create a problem at the newel ends of the conveyor where the handrail reverses its direction of movement. If a passenger is carrying packages, a shopping bag, a briefcase, or the like, the item can bump into the handrail at the newels, and could be dropped. Likewise, one might catch a sleeve or scarf, or the like, between the moving handrail and its stationary guide at the newel ends of the escalator. This can be a particular problem at the exit end of the escalator.

DISCLOSURE OF THE INVENTION

This invention is directed to a streamlined deflector which is mounted on the balustrade of the escalator or horizontal passenger conveyor at the newel ends. The deflector is provided with a tapered skew side surface which will smoothly move anything that touches it outwardly away from the balustrade to the outer edge of the moving handrail. The deflector tracks the handrail from the end of its horizontal path to its passage into the reentry housing. The deflector can be internally illuminated for appearance and awareness enhancement. When illuminated in this fashion, the deflector will be formed from a molded transparent or translucent plastic. Alternatively, the deflector could be made from metal, wood or some other opaque material.

It is therefore an object of this invention to provide a streamlined escalator or other passenger conveyor with an object deflector adjacent to the moving and rail on the balustrade at the newel ends of the escalator.

It is a further object of this invention to provide an escalator of the character described where the deflector is mounted on the balustrade and prevents objects carried by passengers from striking the moving handrail when exiting the escalator.

It is an additional object of this invention to provide an escalator of the character described wherein the deflector is operable to gradually divert objects away from the moving handrail.

It is another object of this invention to provide an escalator of the character described wherein the deflector is highlighted by interior illumination.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
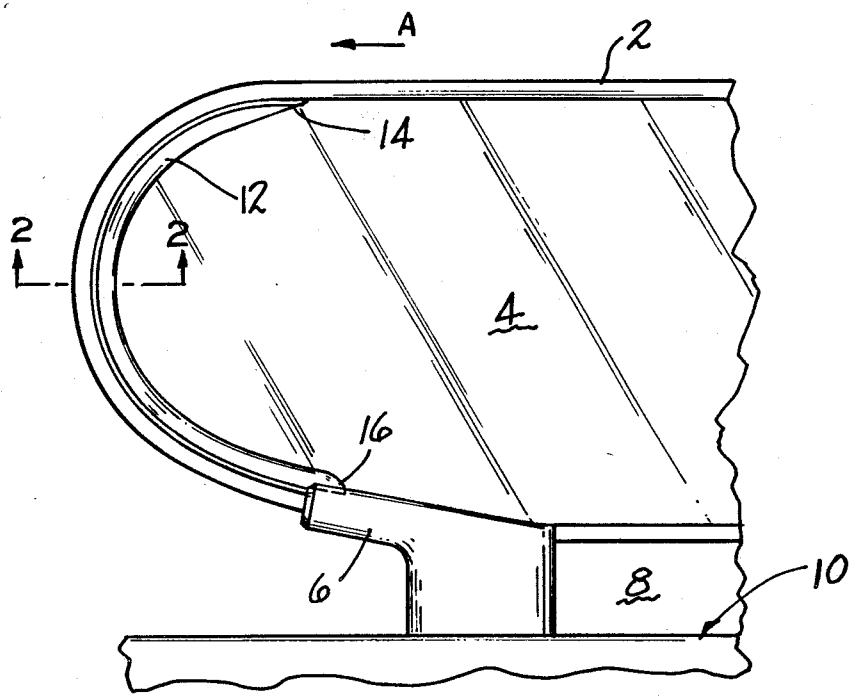
FIG. 1 is a fragmented side elevational view of a newel end of an escalator or horizontal moving walkway showing the deflector mounted in the balustrade adjacent the turnaround path of the handrail.

Referring now to the drawings, there is shown in FIG. 1 the exit newel end of an escalator or horizontal passenger conveyor which has a moving handrail 2 which passes along the periphery of a glass, or the like, thin balustrade 4. The handrail 2 moves in the direction of the arrow A, around the curved end of the balustrade 4 and into the reentry housing 6. Side skirts 8 flank the tread 10 on which the passengers stand. It will be understood that the view in FIG. 1 is taken from the tread side of the balustrade 4 looking out. The deflector 12 is mounted on the balustrade 4 directly adjacent to the handrail 2, and the deflector 12 traverses the entire extent of the exposed curved path of travel of the handrail 2. Accordingly, the lead end 14 of the deflector 12 extends into the upper horizontal path of travel of the handrail 2, and the trailing end 16 of the deflector 12 overlaps the reentry housing 6.

Figure 2:
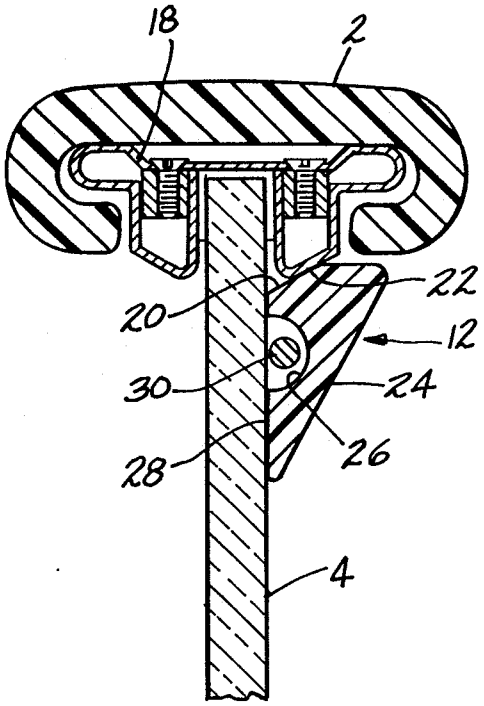
FIG. 2 is a sectional view taken along line 2—2 of FIG. 1.

Referring to FIG. 2, the handrail guide 18 over which the handrail 2 moves is shown. The deflector 12 mounted on the balustrade 4 closely adjacent to the underside of the handrail 2. It will be noted that a surface 20 on the deflector 12 contacts a lower surface 22 on the guide 18 to properly position the deflector relative to the handrail 2. The deflector 12 has an outer tapered surface 24 which obliquely extends from the balustrade 4 to the lower surface of the handrail 2. This is the contact surface. It will be noted that objects moving parallel to the balustrade 4 which encounter the deflector contact surface 24 will simply slide along the surface 24 away from the balustrade 4 and around the outside of the handrail 2. The deflector 12 is secured to the balustrade preferably by means of an adhesive. A groove 26 is formed in the surface 28 of the deflector 12 which abuts the balustrade 4. A light source 30 is disposed in the groove 24 so as to illuminate the deflector 12 from within. The light source 30 can be a neon light source, a fiber optic light source, or any other light source suitable for the disclosed environment. Energy for powering the light source can be batteries, a generator, or the like. The light source could also be chemically activated, if so desired.

It will be readily appreciated that the escalator of this invention retains the sleek streamlined look, while eliminating the problem of carried objects or the like striking the downwardly moving handrail at the exit newel, which if not prevented would tend to knock the object out of one's hands toward the floor. The deflector serves to smoothly direct such objects outwardly away from the balustrade and around the handrail. The provision for internal illumination of the deflector enhances both its esthetics, and also one's awareness of it.

Since many changes and variations of the disclosed embodiment of the invention may be made without departing from the inventive concept, is not intended to limit the invention otherwise than as required by the appended claims.

What is claimed is:

1. An escalator or the like comprising:

(a) a moving treadway;

(b) a thin balustrade flanking said threadway;

(c) a handrail guide rail mounted on a peripheral edge of said balustrade;

(d) a moving handrail mounted on said handrail guide rail for use by passengers standing on said treadway, said handrail having a transverse dimension which is substantially larger than the thickness of said balustrade whereby said handrail has an inner side edge which projects inwardly from the corresponding inner side of said balustrade toward passengers;

(e) said handrail passing over a curved return newel portion of said balustrade at an exit end of the escalator; and (f) a deflector mounted on said balustrade at said newel portion thereof, said deflector being closely adjacent to said handrail throughout said newel portion of said balustrade; said deflector having a skew contact surface thereon which extends from a line on the threadway side of said balustrade below said handrail, to a line immediately below the treadway side edge of said handrail whereby said contact surface gradually deflects objects which encounter it away from said balustrade and around said handrail; and a means for internally illuminating said deflector.

2. The escalator of claim 1 further comprising a zone of linear movement of said handrail entering said newel portion of said balustrade, and a reentry housing receiving said handrail exiting said newel portion, and said deflector having an entry end part disposed in said zone of linear movement, and an exit end part overlapping said reentry housing.

3. The escalator of claim 1 wherein said deflector includes a locating surface which abuts a surface of said handrail guide rail to properly position said deflector with respect to said handrail.

4. The escalator of claim 1 wherein said means for internally illuminating comprises a slot formed in a surface of said deflector which fronts said balustrade said slot extending from one end of said deflector to the other; and a light source disposed in said slot.

5. The escalator of claim 4 wherein said light source comprises a fiber optic element.

6. An escalator or the like comprising:

(a) a moving treadway;

(b) a thin balustrade flanking said treadway;

(c) a handrail guide rail mounted on a peripheral edge of said balustrade;

(d) a moving handrail mounted on said handrail guide rail for use by passengers standing on said treadway, said handrail having a transverse dimension which is substantially larger than the thickness of said balustrade whereby said handrail has an treadway side edge which projects inwardly from the corresponding treadway side of said balustrade toward passengers; said handrail passing over a curved return newel portion of said balustrade at an exit end of the escalator;

(e) a deflector mounted on said balustrade at said newel portion thereof, said deflector being closely adjacent to said handrail throughout said newel portion of said balustrade, and said deflector having a contact surface thereon which extends from a line on the treadway side of said balustrade below said handrail toward said treadway side edge of said handrail to form means for gradually deflecting objects which encounter it away from said balustrade and around said handrail; and (f) means for internally illuminating said deflector.

7. The escalator of claim 6 wherein said means for internally illuminating comprises a slot formed in a surface of said deflector which fronts said balustrade, and a light source positioned in said slot.

8. The escalator of claim 7 wherein said slot extends from one end of said deflector to the other, and said light source is a fiber optic light device.

* * * * *

UNITED STATES PATENT AND TRADEMARK OFFICE

CERTIFICATE OF CORRECTION

PATENT NO. : 4,896,759

DATED : January 30, 1990

INVENTOR(S) : Hella Badstuebner and Walter Tietze

It is certified that error appears in the above-identified patent and that said Letters Patent is hereby corrected as shown below:

| | |
|---|---|
| Column 1, Line 52 | cancel the phrase "and rail" and substitute the word --handrail--. |
| Column 3, Line 20 | cancel "and" |
| Line 33 | At the beginning of the line which starts with the words "a means for internally", insert --(g)--. |
| Column 4, Line 19 | Cancel "an" and substitute --a--. |

Signed and Sealed this

Sixth Day of August, 1991

*Attest:*

HARRY F. MANBECK, JR.

*Attesting Officer*

*Commissioner of Patents and Trademarks*